US007137571B2

(12) United States Patent
Caley et al.

(10) Patent No.: US 7,137,571 B2
(45) Date of Patent: Nov. 21, 2006

(54) FUEL INJECTOR NOZZLES

(75) Inventors: David James Caley, Sorrento (AU); Hugh William Carlisle, Sorrento (AU); Robert Walter Frew, Scarborough (AU); David John Longman, City Beach (AU)

(73) Assignee: Orbital Engine Company (Australia) Pty Limited, Balcatta WA (AU)

( * ) Notice: Subject to any disclaimer, the term of this patent is extended or adjusted under 35 U.S.C. 154(b) by 0 days.

(21) Appl. No.: 10/257,003

(22) PCT Filed: Apr. 5, 2001

(86) PCT No.: PCT/AU01/00382

§ 371 (c)(1),
(2), (4) Date: Mar. 7, 2003

(87) PCT Pub. No.: WO01/77518

PCT Pub. Date: Oct. 18, 2001

(65) Prior Publication Data

US 2003/0160114 A1 Aug. 28, 2003

(30) Foreign Application Priority Data

Apr. 5, 2000 (AU) ..... PQ6715

(51) Int. Cl.
*B05B 1/24* (2006.01)

(52) U.S. Cl. ..... 239/132; 239/397.5; 239/453; 239/523; 239/533.7; 239/533.12; 239/584

(58) Field of Classification Search ..... 239/397.5, 239/533.3, 533.7, 533.12, 452, 453, 456, 239/523, 524, 584, 507, 288, 125, 132–132.5, 239/DIG. 19

See application file for complete search history.

(56) References Cited

U.S. PATENT DOCUMENTS 3,612,012 A * 10/1971 Dreisin ..... 239/533.3

(Continued)

FOREIGN PATENT DOCUMENTS

WO WO 89/04920 1/1989

OTHER PUBLICATIONS

Title: 00/2347 Injection Nozzles User: cpatok—Kurt Tobler, S3-64 PAN: 93-194705, p. 1 of 1, Tue' Oct. 17 16:55:09, Viewed Marked.

European Examination Report, Jan. 17, 2005, For corresponding European Patent Application No. 01 918 999.

*Primary Examiner*—Steven J. Ganey
(74) *Attorney, Agent, or Firm*—Rothwell, Figg, Ernst & Manbeck

(57) ABSTRACT

Disclosed is an injector nozzle through which fluid is delivered and which has a port (17) having an internal surface and a valve member (13) having a complementary external surface. The valve member (13) is movable relative to the port (17) to respectively provide a passage between the internal and external surfaces for delivery of fluid in the form of a spray. Alternatively, sealed contact of the surfaces will prevent the delivery of fluid.

The nozzle includes a flow control body (30) located beyond an extremity of the port (17). The flow control body (30) has a control surface (33) arranged downstream of the port (17) in the direction of movement of the valve member (13). The control surface (33) is configured and positioned to promote the fluid spray established by the fluid issuing from the port (17) to in part follow a path determined by the shape of the control surface (33). The flow control body (30) includes an insulating region (140, 141) arranged to restrict heat transfer from the control surface (33) to the nozzle. The insulating region (140, 141) may be the spacing between the surface (30*a*) of the flow control body (30) closest to an end face (14*a*) of the valve member (13) and that end face (14*a*).

42 Claims, 5 Drawing Sheets

U.S. PATENT DOCUMENTS 4,408,722 A * 10/1983 Frelund ..... 239/453
4,434,940 A 3/1984 Kupper et al.
4,502,196 A 3/1985 Kupper et al.
4,817,873 A * 4/1989 McKay ..... 239/397.5
5,551,638 A 9/1996 Caley
5,833,142 A 11/1998 Caley
5,915,352 A * 6/1999 Okamoto et al. .... 239/DIG. 19

* cited by examiner

FUEL INJECTOR NOZZLES

This invention relates to a valve controlled nozzle for the injection of fluid and more particularly to a valve controlled nozzle for the injection of fuel in an internal combustion engine. In this specification, the term "internal combustion engine" includes engines having an intermittent combustion cycle such as reciprocating or rotary engines operating on either the two or four stroke cycle.

The characteristics of the fuel spray delivered from an injector nozzle to an internal combustion engine, such as directly into a combustion chamber of the engine, have a major effect on the control of the combustion of the fuel, which in turn affects the stability of the operation of the engine, the engine fuel efficiency and the composition of the engine exhaust gases. To optimise these engine operation outcomes, particularly in a spark ignited engine, the desirable characteristics of the fuel spray issuing from the injector nozzle typically need to include small fuel droplet size (liquid fuels), controlled spray geometry and, in the case of direct injected engines, controlled penetration of the fuel into the combustion chamber. Further, at least at low fuelling rates, a relatively contained and evenly distributed ignitable cloud of fuel vapour in the vicinity of the engine spark plug is desirable.

Some known injector nozzles, particularly those used for the delivery of fuel directly into the combustion chamber of an engine, are of the outwardly opening poppet valve type and typically deliver the fuel in the form of a cylindrical or divergent conical spray. In such injector nozzles, the nature of the shape of the fuel spray is typically dependent on a number of factors. These factors include the geometry of the exit port and valve constituting the nozzle, especially the surfaces of the port and valve immediately adjacent the valve seat, where the port and valve sealingly engage when the nozzle is closed. Once a nozzle geometry has been selected to provide a desired performance of the injector nozzle, and hence the combustion process, it is important to maintain such geometry otherwise the performance of the engine can be impaired, particularly at low fuelling rates. This is also true for certain designs of inwardly opening pintle valve type injector nozzles.

The attachment or build-up of solid combustion products or other deposits on the nozzle surfaces over which fuel flows can affect the geometry of the fuel flow path through the open nozzle and can therefore affect the creation of a desired fuel spray shape, the correct fuel distribution, and hence the engine combustion process. The principal cause of build-up on these surfaces is the adhesion thereto of carbon particles or other particles that arise from the combustion of the fuel, including incomplete combustion of residual fuel left on these surfaces between injection cycles. Methods of reducing or controlling such build-up are known as disclosed in the Applicant's U.S. Pat. Nos. 5,090,625, 5,593,095 and 5,685,492, the contents of which are hereby incorporated herein by way of reference.

It is also known that a hollow spray or fuel plume issuing from a nozzle initially follows a path principally determined by the exit direction and exit velocity of the fuel. It is further also known that, as the fuel spray advances beyond the delivery end of the injector nozzle, a pressure is created within the area bound by the spray immediately downstream of the nozzle that is lower than the pressure on the outside of the fuel spray and which promotes an inward contraction of the spray. This phenomenon is referred to as "necking".

It has been found that disturbances to the fuel flow issuing from an injector nozzle can significantly influence the shape of the fuel spray or plume, particularly during and subsequent to the necking thereof. Such influences can promote unpredictable deflection and/or dispersion of the fuel, which in turn can adversely affect the combustion process. Increases in fuel consumption, undesirable levels of exhaust emissions, and engine operating instability, particularly during low load operation, are examples of possible adverse effects.

Disturbances that can cause such undesirable effects include the presence of irregular deposits on the surfaces defining the injector nozzle exit such as carbon and other combustion related deposits, eccentricity of the valve and seat components of the nozzle, and/or excessive clearance between the stem supporting the valve and the bore in which the valve stem axially moves as the valve opens and closes the injector nozzle exit. Lateral movement or eccentricity of the valve, and deposits on the surfaces of the valve or valve seat can each result in changes in the relative rate of flow through different sections of the periphery of the nozzle, thus causing an assymetric fuel spray.

The above discussed disturbances to the delivery of fuel, for example into the engine combustion chamber, are particularly significant in engines operating with a highly stratified air/fuel mixture, such as is recognised as highly desirable to control exhaust emissions during low load operation.

The Applicant's U.S. Pat. No. 5,551,638 discloses an injector nozzle with a guide projection dependent from the valve head thereof and having an external toroidal surface. A fuel plume issuing from the nozzle typically follows a path based on the external surface of the projection. The guide projection may preferably be necked inwards immediately adjacent the valve member and thereafter may be of a converging circular shape, and more generally of an inverted truncated conical shape. The guide projection provides a surface which aids in the control of the fuel plume shape and to a certain extent corrects disturbances to that shape caused by carbonaceous deposits in or on the surface of the nozzle port or valve member.

The Applicant's further U.S. Pat. No. 5,833,142 discloses an alternative form of injector nozzle with a guide projection arranged thereon. The nozzle includes a port having an internal surface, a valve member having a complementary external surface, and a flow control body located beyond an extremity of the body of the nozzle corresponding to the location, of the port. The flow control body has a control surface configured and positioned such that the fuel spray established by fluid issuing from the port will follow a path determined at least in part by that control surface. The flow control body is in certain arrangements partly hollow.

Flow control bodies or guide projections of this kind stabilise the fluid or fuel spray by providing a physical surface to promote some spray guidance downstream of the nozzle. This has the result of reducing lateral deflection of the fuel or fluid during the injection period. Guidance of the fluid or fuel spray by the control surface of the flow control body typically promotes uniformity in the direction of the fluid spray into the engine combustion chamber, countering other influences that could cause irregularities or diversion of the fuel or fluid spray or portions thereof. The guidance of the fuel or fluid spray may also aid in the correction of differences in, or disturbances to, the spray arising from manufacturing variations including tolerance variations from injector nozzle to injector nozzle.

Nevertheless, despite the real improvements that may be achieved through use of the above proposals, a certain degree of carbon deposits may continue to occur on injector nozzles, particularly on and adjacent the nozzle exit surfaces and on a necked portion of the guide projection. Such carbon deposits at the nozzle exit surfaces and on the necked portion may disrupt the injected spray plume, altering the fuel spray characteristics upon delivery into the combustion chamber. Particular problems that may result are detrimental effects on combustion stability, smoke levels, fuel consumption and engine exhaust emissions. These may lead to poor vehicle driveability and/or the inability to meet prescribed emissions/fuel economy targets both of which may be prescribed by relevant environmental legislation.

It is therefore the object of the present invention to provide an injector nozzle that will contribute to improved control of the shape and direction of the fluid or fuel plume and hence improve the performance and efficiency of the injector nozzle and/or engine performance and vehicle driveability generally.

With this object in view, the present invention provides an injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of movement of the valve member, said control surface being configured and positioned to promote the fluid spray established by the fluid issuing from the port to in part follow a path determined by the shape of said control surface wherein said flow control body includes an insulating region arranged so as to restrict the transfer of heat from the control surface to the nozzle.

Preferably, the flow control body is arranged on a connection portion connected to the nozzle. Conveniently, the connection portion is connected to and extends downwardly from an end face of the valve member of the nozzle and the insulating region is arranged so as to restrict the transfer of heat from the control surface to the valve member.

Preferably, the insulating region is arranged such that a portion of the control surface of the flow control body which is closest to the end face of the valve member is spaced therefrom by the insulating region.

Preferably, the insulating region is arranged such that it extends between a surface of said connection portion and an opposed surface of said flow control body. Conveniently, the opposed surface of said flow control body is located adjacent a portion of the control surface of the flow control body.

Conveniently, the control surface may comprise a member of external projection surfaces which together define the control surface. The external projection surfaces may be arranged in different places or at various orientations with respect to each other.

Conveniently, the flow control body is separated from the nozzle by way of a necked-in portion such that the control surface of the flow control body is spaced from the nozzle port in the direction of movement of the valve member. Conveniently, the flow control body is connected to the end face of the valve member by the necked-in portion.

Preferably, the insulating region may simply be constituted by an insulating gap portion or air gap. That is, the insulating gap may be left empty, to be filled by air or gases present within, for example a combustion chamber, at a given time. Alternatively, the insulating gap may be partially or wholly filled by another heat insulating or low thermal conductivity material. The width of the gap may be calculated in accordance with a desired temperature profile to be achieved throughout the flow control body and valve member to optimise, that is maximise, heat retention in the flow control body and particularly at the control surface thereof. Alternatively, it may be determined by experiment. In particular, the insulating region or gap is arranged such that the control surface or external projection surfaces of the flow control body may during operation be maintained at temperatures above the carbon forming range to promote effective deposit control.

Conveniently, the flow control body is arranged on the connection portion such that the insulating region is located between the end face of the valve member and an uppermost portion of the flow control body. Conveniently, the insulating region is arranged to be located within an upper section of the necked-in portion immediately adjacent the valve member.

The flow control body may be formed with a bore extending partially or wholly therethrough to allow connection to the connection portion which may conveniently take the form of a spigot portion of relatively narrow diameter relative to that of the flow control body at any point along its length. The connection portion or spigot may be of the same or different material of construction to that of the flow control body and may be formed integral therewith. The connection therebetween may be by press or interference fitting of the flow control body onto the connection or spigot portion supplemented by welding, soldering or other fixing or mounting techniques. Preferably, the bore within the flow control body may be coaxial with the axis of the valve member and port of the nozzle. The bore may be formed with two sections of differing diameter. An upper section disposed axially inwardly toward the end face of the valve may have a greater diameter than a lower section disposed axially outwardly from the upper section. The upper section of the bore may be bevelled or tapered in order to maintain an insulating gap at the transition region between the end face of the valve member and the connection or spigot portion. This upper section may have a surface being the surface of the flow control body which opposes a surface of the connection or spigot portion to define the insulating gap portion therebetween.

Advantageously, the flow control body may be fixedly connected to the connection portion to form a multi-part, preferably two-part, flow control assembly by the above or other techniques. Such connection is conveniently configured to leave an insulating gap that extends between the surface of the flow control body closest to the end face of the valve member and the end face itself. The insulating region may also comprise an insulating gap portion extending in a preferably longitudinal direction along the axis of movement of the valve member between the surface of the connection or spigot portion and the opposed surface of the wall defining a portion, for example the upper section, of the bore of the flow control body. This would serve to further reduce the heat transfer area between the control surface of the flow control body and the connection or spigot portion and valve member.

In accordance with a further aspect of the present invention there is provided a fuel injector nozzle having a port through which at least fuel is delivered to an engine, said nozzle further comprising a flow control body arranged external to said port,whereby in use said nozzle includes a relatively cool region adjacent said port arising as a consequence of fuel located internally of said nozzle and a relatively hot region on said flow control body arising as a consequence of exposure to relatively high combustion chamber temperatures, said cool region and said hot region giving rise to a thermal gradient region therebetween, and wherein at least a portion of said flow control body includes a thermal insulating region, said insulating region being located intermediate at least a portion of said cool region and at least a portion of said hot region such that said thermal gradient region is controlled so as to be contained within the flow control body.

Conveniently, said flow control body includes an external control surface and said hot region is primarily located at or immediately adjacent the external control surface. Conveniently, said gradient region is controlled to be contained internally of the external control surface of the flow control body.

Preferably, a portion of said hot region is arranged in close proximity to said cool region but is separated therefrom by way of the insulating region. Similarly, a portion of said hot region is preferably arranged to be in close proximity to said gradient region but is separated therefrom by way of the insulating region. Conveniently, said portion of said hot region adjacent said cool region extends away from said cool region substantially independent of the thermal gradient region.

Preferably, said flow control body defines an extremity of said nozzle and said hot region extends from said external control surface of said flow control body internally of said flow control body. Preferably said cool region extends from adjacent said port in a direction away from said extremity of the nozzle.

Preferably said flow control body and said thermal gradient region comprise material having relatively high thermal conductivity characteristics whilst said insulating region conveniently has relatively low thermal conductivity characteristics.

Preferably said relatively low thermal conductivity characteristics are of the order of 0.02 Watts per metre Kelvin, such as are typical of air, although slighly higher thermal conductivity characteristics of the order of 0.05 Watts per metre Kelvin, such as exist in carbon may also be applicable. Preferably, said relatively high thermal conductivity characteristics would include a value typically attained by say stainless steel and would preferably be in the order of 20 Watts per metre Kelvin or above.

Preferably said relatively hot region is during operation at a temperature above which combustion deposits form. In contrast, said relatively cool region preferably has a temperature at or below that at which combustion deposits form.

Connection with the flow control body may be made such that the connection or spigot portion extends only partially through the bore leaving a portion as a hollow cavity to further reduce heat flow to the valve member and/or to reduce impact effects. Such a hollow cavity could alternatively be filled with a low thermal conductivity material.

The flow control body may be configured and positioned to promote the fuel spray to contract inwardly to follow a path determined by the shape of the control surface. The control surface may be an external surface but, for other applications, an internal control surface may be more appropriate.

The flow control body may be of substantially circular cross-section throughout its length, progressively increasing in diameter from the end thereof remote from the end face of the valve member to an intermediate diametral plane and progressively decreasing in diameter from said intermediate diametral plane toward the other end of the flow control body. The flow control body may preferably include an upper conically divergent portion disposed axially inwardly toward the end face of the valve member and a lower conically convergent portion disposed axially outwardly from the conically divergent portion. A generally cylindrical junction portion of constant circular cross-section over its length may in certain arrangements space the conically convergent and conically divergent portions. The conically divergent portion may include a generally cylindrical sleeve portion extending in a longitudinal direction along the axis of movement of the valve member. The bore may pass through this portion to enable connection to the connection or Spigot portion.

However, the flow control body may alternatively be of a wide variety of geometric shapes both in cross-section and lengthwise, including assymetric cross-sections or a cross-section of constant geometry but varying cross-sectional area. Further, the flow control body may be provided with internal or external grooves or channels that may assist in the shaping of a desired spray geometry. Such grooves or channels may also provide an increased surface area of the flow control body which may be useful in achieving greater heating of the control surface of the flow control body. The flow control body could have provided on a surface thereof supports, ribs or other structures to provide rigidity at peripheral extremeties of the air gap, for example at the uppermost surface of the flow control body.

While the axis of the flow control body may coincide with the axis of the valve member and the direction of movement thereof, the axis of the flow control body may be inclined to, or offset from, the former axis. Such inclination or offset allows for deflection or guidance of a fuel plume in a desired direction not co-axial with the axis of the valve member and port. Symmetrical or assymetrical disposition of the flow control body relative to said axis is also possible.

The flow control body and/or the connection or spigot portion may be formed with hollow portions or cavities filled with low thermal conductivity materials to further enhance heat retention properties due to a reduced conductive flow path through which heat can pass to the fuel cooled portions of the valve member and/or nozzle (i.e., the relatively cool region).

Thus, by use of the multi-part flow control assembly above described, high temperatures may be more effectively maintained at the control surface of the flow control body in a manner such that heat may be transferred by conduction from the hot base of the flow control body, where maximum temperature is typically attained, to the remaining outer portions of the flow control body. Hence, problems arising from carbon deposition on the surfaces of the flow control body, nozzle and/or valve member are likely to be less significant. Further, in the case of a flow control body connected to a moving valve element, any reduction in weight that may be achieved by provision of such hollow portions or cavities results in a more responsive valve mechanism. Still further, the hollow construction employed in the configuration of the flow control body may extend into the valve member itself, thus reducing the impact momentum upon opening and closing movement of the valve member.

The present invention may advantageously be applied to a fuel injector nozzle as used in an internal combustion engine, and particularly, a fuel injector nozzle of the poppet or pintle type for delivering fuel directly into the combustion chamber of an engine. Such fuel may advantageously be entrained in a combustion supporting gas such as air as described in the Applicant's U.S. Pat. No. RE36768, the contents of which are incorporated herein by way of reference. Such air-assist or dual fluid fed injection systems generally use a source of compressed air or gas to entrain and deliver a pre-metered quantity of fuel to the engine throughout the operation thereof. Fuel injector nozzles of this type may readily be applied in direct injected four stroke cycle internal combustion engines operated in accordance with the Applicant's patented combustion process. Such fuel injector nozzles may however also be applied to two stroke cycle internal combustion engines or other engines. Other non-engine applications may also exist.

The fuel injector nozzle of the present invention substantially reduces the cross-sectional area of a heat flow path through which heat can flow from the flow control body to the fuel cooled portions of the valve member and nozzle and hence be dissipated through the injector nozzle to the engine cylinder or cylinder head. Such physical isolation of the critical surfaces of the flow control body, where carbon deposits may occur if heat retention is insufficient, from the cooler valve member and nozzle by the insulating region or gap promotes heat retention in the flow control body. This is turn maintains the body at a sufficiently high temperature to burn off any carbon or other particles that develop or are deposited on the surface thereof. This hence enables a more reliable and repeatable fuel spray shape and distribution to be achieved during operation.

In this manner, the use of the flow control body to aid in the control of the configuration and path of the fluid or fuel spray created as fluid or fuel issues from the injector nozzle is enhanced significantly contributing to better management of the combustion process and hence, better control of exhaust emissions and engine fuel efficiency. This is particularly advantageous in direct injected stratified charge engines wherein at certain engine operating points a relatively contained and easily ignitable fuel cloud is respectably required for satisfactory engine opertion.

The invention will be more readily and completely understood from the following description of a preferred embodiment of the fuel injector nozzle of the invention made with reference to the accompanying drawings in which.

Figure 1:
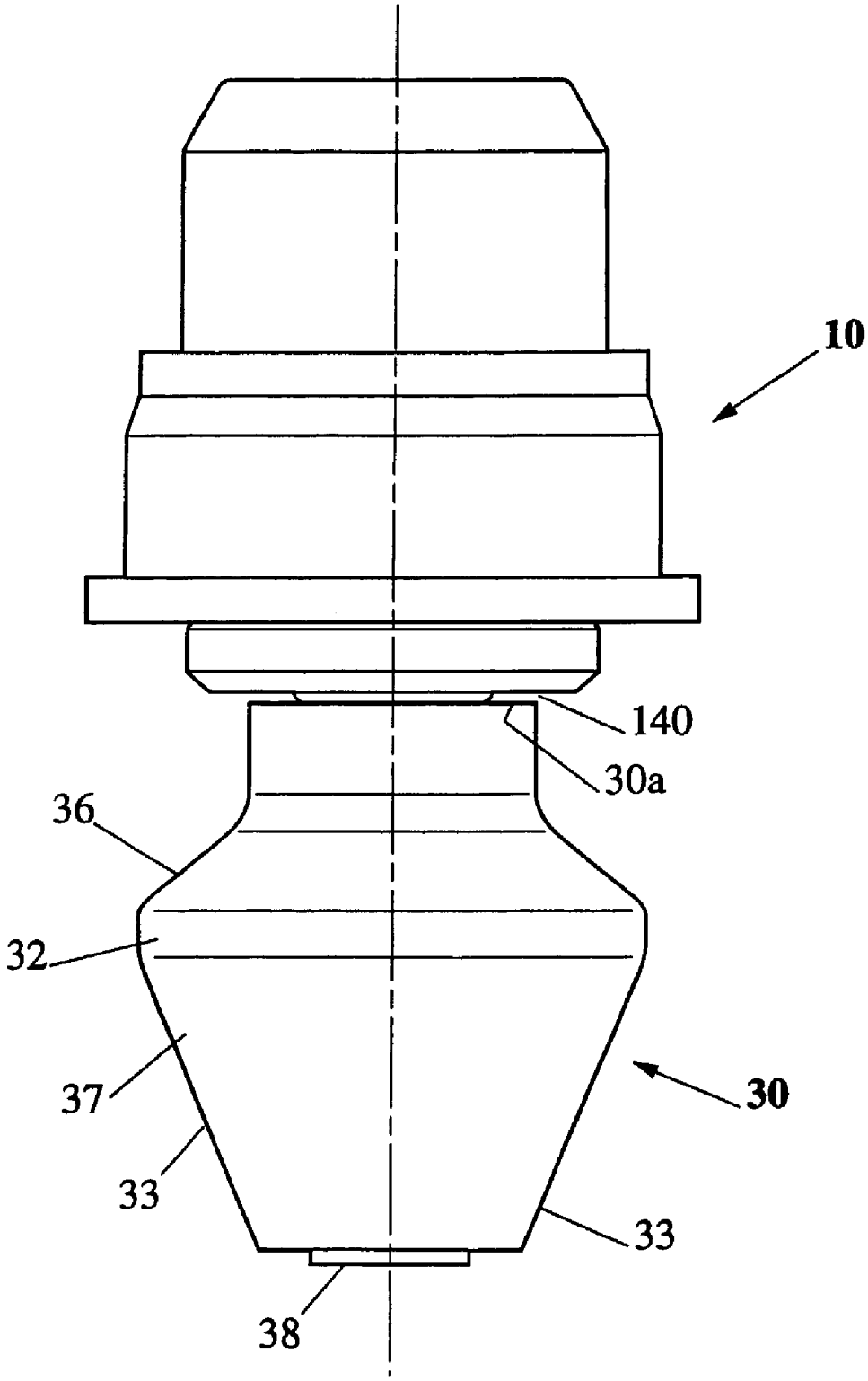
FIG. 1 is a perspective view of the injector nozzle in accordance with one embodiment of the present invention.

The fuel injectors, valves, valve members and flow control bodies as depicted in FIGS. 1 to 7 and hereinafter described can be incorporated into a wide range of fuel injection systems used for the delivery of fuel into the combustion chamber(s) of an engine. Typical forms of injectors or injection systems in which these components may be incorporated are disclosed, by way of example only, in the Applicant's U.S. Pat. Nos. RE36768 and 5,593,095, the contents of which are incorporated herein by way of reference.

Referring now to FIGS. 1 to 4 of the drawings, the body 10 of the fuel injector nozzle is of a generally cylindrical shape and comprises a central bore 12 therethrough. A valve member 13 is arranged to co-operate with the bore 12 of the nozzle body 10 and includes a valve head 14 and a valve stem 15. The stem 15 has a guide portion 18 which is axially slidable in the bore 12 of the nozzle body 10. The valve stem 15 is hollow so that the fuel and/or air can be delivered therethrough, and openings 16 are provided in the wall of the stem 15 to permit the fuel and/or air to pass from the interior of the stem 15 into the bore 12.

The valve head 14 is of a part-spherical form and is received in a port 17 provided in an end of the nozzle body 10 which communicates with the bore 12. The wall of the port 17 is of a frusto-conical form and engages the valve head 14 along the seat line 20 when the valve 13 is in the closed position. Depending in an outwardly axial direction from valve head 14 is a flow control assembly comprising a connection or spigot portion 38 to which is fixedly mounted a flow control body 30 which forms a further portion of the flow control assembly. The flow control assembly may be seen to be a two part assembly of spigot portion 38 and flow control body 30, though subject to manufacturing constraints, any number of parts may form the assembly. An integral construction is equally possible.

Flow control body 30, which preferably has a substantially circular cross-section throughout its length, has an inward surface 30*a* spaced from the closest surface 14*a* of valve head 14 by an insulating gap 140 which may be an air gap or a gap that would be filled by gases present in the combustion chamber of the engine at any given time. However, the gap 140 may be filled, partially or wholly, by another low thermal conductivity material as an alternative. The dimensions of the gap 140 may be selected to optimise the maximum temperature of the flow control body 30 subject to any mechanical or cost constraints. Such selection may be by calculation or experiment.

Figure 5:
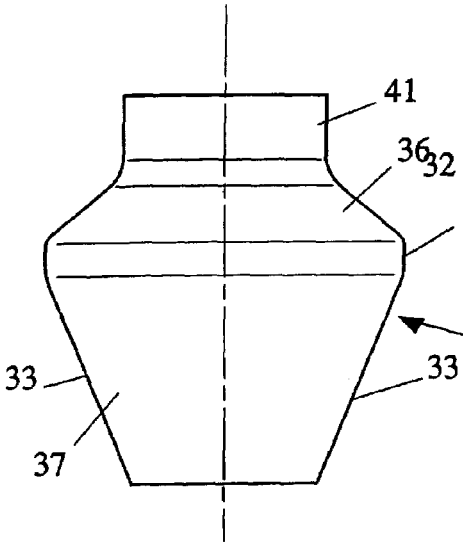
FIG. 5 is a perspective view of a flow control body used in accordance with one embodiment of the injector nozzle of the present invention.

The flow control body 30, shown also in perspective in FIG. 5 and which may be configured as a separate component, is preferably comprised of an upper or inward conically divergent (with respect to an axis of the valve member 13) portion 36, and a lower or outward conically convergent (with respect to an axis of the valve member 13) portion 37 separated by a cylindrical junction portion 32 of substantially constant diameter. The junction portion 32 may alternatively simply comprise a diametral plane at which transition from portion 36 to portion 37 occurs. Both portions 36 and 37 are of truncated conical shape and together with junction portion 32 define an external surface 33 as a control surface for the flow control body 30. Upper portion 36 may further include a generally cylindrical extension or sleeve portion 41 having an inner wall 41*a* opposed to, and spaced from, a surface 38*a* of spigot 38 on fitting of the flow control body 30 thereon. Upper portion 36 and sleeve portion 41 together define an essentially necked-in section arranged downstream of the valve head 13. This necked-in section may be more pronounced in certain applications.

The diameter of the junction portion 32 between the two truncated conical portions 36 and 37 may be selected so that the fuel spray issuing from the port 17 when open, will follow a path based on the external surface 33 of the flow control body 30 and more particularly the portion of the control surface defined by portions 32 and 37. The diameter of junction 32 to promote attachment of the inner boundary layer of the issuing fuel spray to the external surface 33 of the flow control body 30 so that the fuel spray will follow a path complementary to surface 33 is largely determined experimentally.

The configuration of the external surface 33 may be selected to specifically direct the fuel in a desired direction not co-axial with the injector nozzle. In this regard, in some applications it may be appropriate to effect a small degree of deflection of the fuel plume, for example, towards a spark ignition means. In that case the flow control assembly, spigot portion 38 or flow control body 30 may be appropriately inclined to the axis of the valve member 13 to provide for a required deflection of the fuel plume. External surface 33 may also be formed with grooves or channels to achieve particularly desired fuel plume characteristics.

The type of flow control body 30 as discussed may of course be substituted by other suitable forms. For example, the flow control body may have a guide surface of tapered form curved in the longitudinal direction with a smooth transition between convergent and divergent portions thereof. The flow control body may alternatively be of prismatic form, for example triangular or rectangular form, or may be cylindrical in form. The flow control body may also be symmetrical or asymmetrical about a central axis of the valve member 13.

Figure 6:
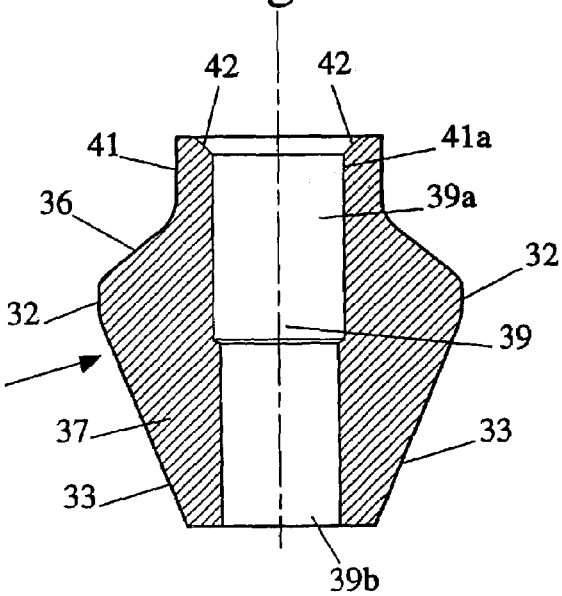
FIG. 6 is a sectional view of the flow control body of FIG. 5.

Through the flow control body 30, and in the case of the preferred flow control body 30, portions 36, 37 and 41 thereof, extends a bore 39 as most clearly seen in FIG. 6. Bore 39 may have a central axis aligned with the central axis of valve member 13 though this is not mandatory. Bore 39 may itself have two sections: an upper or inward section 39*a* and a lower or outward section 39*b*. The inwardly disposed end of section 39*a* may be tapered or bevelled. Both sections 39*a* and 39*b* may be generally cylindrical and co-axial with the central axis of valve member 13 though again neither requirement is mandatory. Any geometry or relation to the central axis of valve member 13 may be adopted. The inward section 39*a* may be of greater diameter than outward section 39*b* serving the following purpose.

Figure 3:
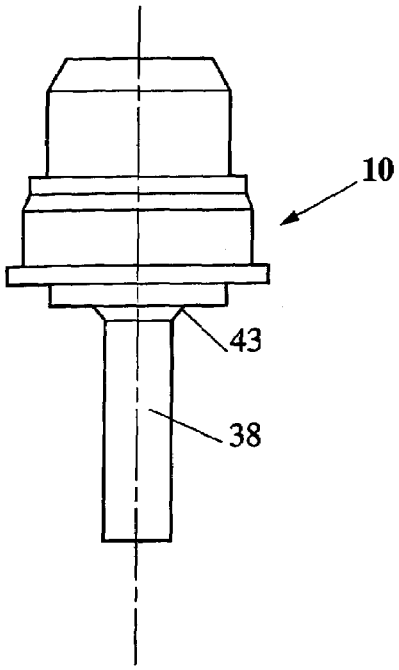
FIG. 3 is a perspective view of the injector nozzle of FIGS. 1 and 2 prior to connection of a flow control body to a valve member thereof.
Figure 4:
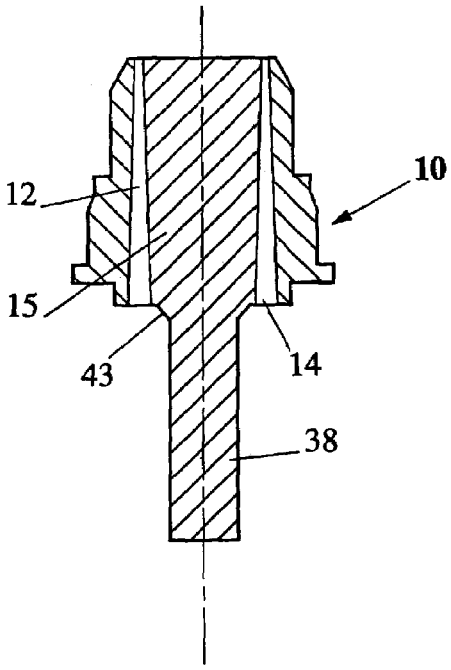
FIG. 4 is a sectional view of the injector nozzle of FIG. 3.

The flow control body 30 is fitted to spigot portion 38, shown prior to this fitting in FIGS. 3 and 4, to form a generally annular insulating gap 140 between the flow control body surface 30*a* closest to the end face 14*a* of the valve head 14. The tapered or bevelled ends 42 of inward section 39*a* of bore 39 allow an insulating gap 140 to be achieved between the flow control body surface 30*a* and the valve head 14 at the transition region 43 between spigot portion 38 and valve head 14.

Figure 2:
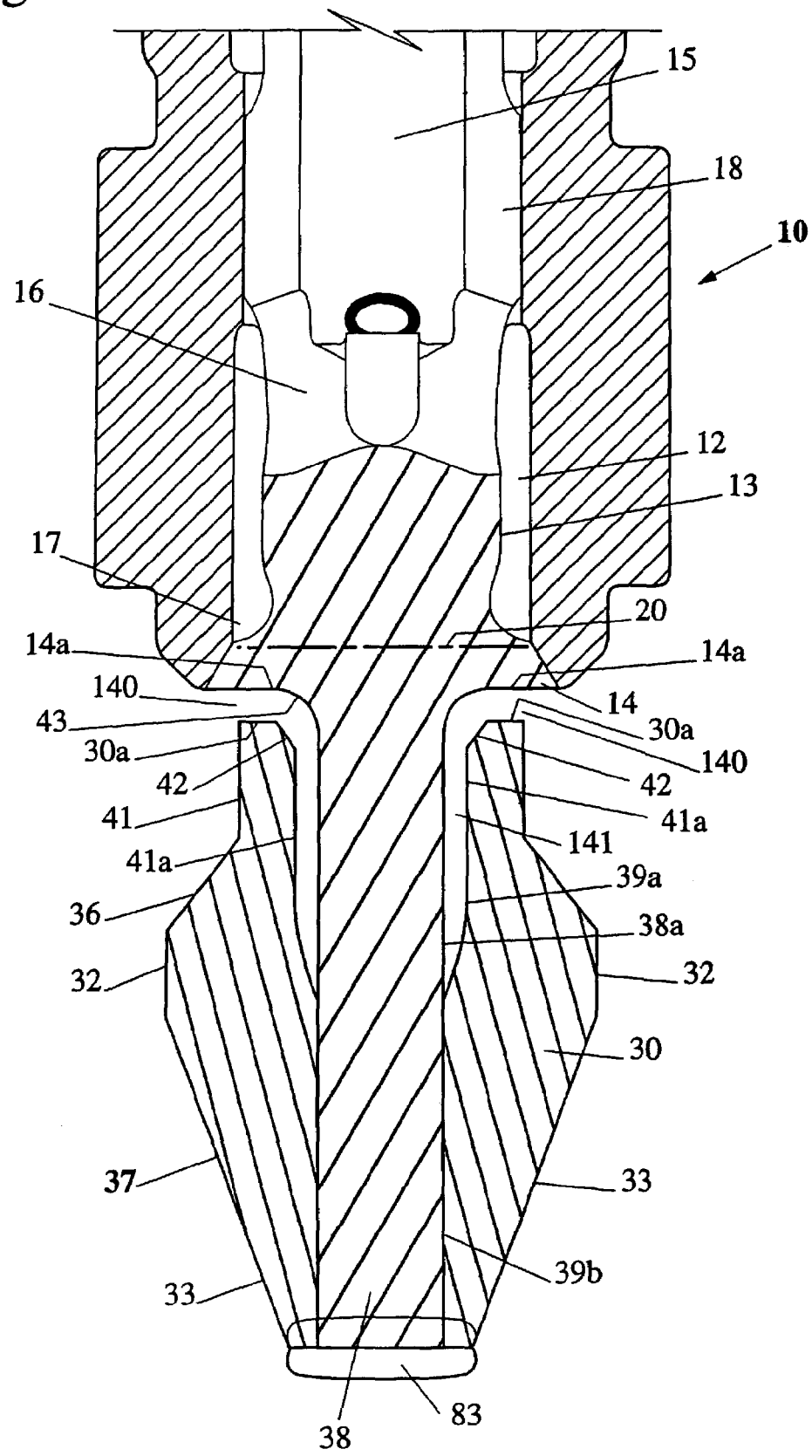
FIG. 2 is a sectional view of the injector nozzle shown in FIG. 1.

Spigot portion 38 may have an interference or press fit with the outward section 39*b* of bore 39 which is of substantially the same diameter as spigot portion 38, though further securement by way of welding or soldering, for example, of the flow control body 30 at the outward end of section 39*b* may be achieved. A welded portion 83 is shown in FIG. 2.

The arrangement of the flow control body 30 and spigot portion 38 as a two piece assembly may provide certain advantages. In particular such an arrangement would enable the same design of injector nozzle to be mated to flow control bodies 30 of different design or configuration. Further, in certain applications, the flow control body 30 may be arranged to be removably attached to the spigot portion 38.

Together with the insulating gap 140, the flow control body 30 includes an insulating gap portion 141 left between the inner wall 41*a* of sleeve portion 41 of flow control body 30, the wall of section 39*a* of bore 39, and the opposed surface 38*a* of spigot portion 38. This results because the inward section 39*a* of bore 39 is of greater diameter than the spigot portion 38. Insulating gap portion 141, having an optimal width of about 0.2 mm, though this may be determined to optimise the maximum temperature of flow control body 30 subject to any mechanical or metallurgical constraints, extends longitudinally (relative to the axis of movement of valve member 14) between inner wall 41*a* of sleeve portion 41, the wall of inward section 39*a* of bore 39, and spigot portion 38. Thus, together, the insulating gaps 140 and 141 define an insulating region within the flow control body 30 having a generally "L-shaped" cross-section. Gap portion 141 may have a terminating end in the outward conically convergent portion 37 of flow control body 30. This insulating gap portion 141 may also be filled with air, or other gases present within an engine combustion chamber at a given time. Alternatively, the insulating gap portion 141 may be filled with another low thermal conductivity material, if desired. In any event, the longitudinal length of the air gap 141 may be selected so as to enable good heat flow to the control surface 33 of the control body 30 whilst restricting the transfer of heat into the spigot portion 38 and hence to the valve member 13 and nozzle body 10. In certain arrangements, the insulating portions 140 and 141 could simply be arranged to be within the flow control body 30.

It may be noted that connection of flow control body 30 to spigot 38 with provision of insulating gap portions 140 and 141 restricts the heat flow from the flow control assembly 30, 38 to the valve member 13 in two ways. Firstly, the spigot portion 38 has a substantially reduced cross-sectional area compared to the flow control body 30 over the length thereof. It may also be noted here that that cross-sectional area may be reduced still further by making spigot portion 38 partially hollow or formed with a core of insulating material. Secondly, insulating gap 140 and insulating gap portion 141 still further restrict the heat flow from the flow control portion 30, 38 to valve member 13 by providing lesser cross-sectional area for heat transfer or flow at the connection between the flow control body 30 and the spigot portion 38. The construction hence promotes heat transfer by conduction from the base of the flow control body 30, where temperature is generally highest, to the external surface 33 thus preventing carbon deposition on that surface, whilst minimizing the conduction of heat to the valve member 13. That is, by physically isolating certain critical surfaces of the flow control body 30 from the injector body 10, heat or high temperatures are retained in the extremeties of the flow control body 30, and particularly at the control surface thereof, whilst such heat is restricted from being transferred into the fuel cooled valve member 13 or nozzle body 10.

If the configuration of the port 17 and valve head 14 provide a fuel spray that diverges significantly outwardly from the nozzle end face 14*a*, it may be desirable to have the diameter of the flow control body 30 at the junction 32 thereof larger than the diameter of the valve head 14. However, the diameter at the junction 32 should not be such as to extend into or through the fuel spray issuing from the nozzle, as this would result in a breaking up and/or an outward deflection of the fuel spray contrary to the aim of the invention.

Further, the diameter of the fuel control body 30 adjacent the nozzle may be less than that of the valve head 14 as, typically, an issuing fuel spray naturally collapses inwardly after leaving the nozzle, as previously referred to, and would be thus brought into contact with the external surface 33 of the flow control body 30. Further, the axial spacing between the end face 14*a* of the valve head 14 and the commencement of the external surface 33 at the junction 32 of the flow control body 30 is selected to promote the attachment of the issuing spray to that external surface 33.

It will be appreciated by those skilled in the art that the dimensions of the flow control body 30 are influenced by a number of factors including the dimensions of the injector nozzle, the nature of the fluid or fuel to be injected and the velocity and direction of fuel or fluid delivery from the nozzle.

Figure 7:
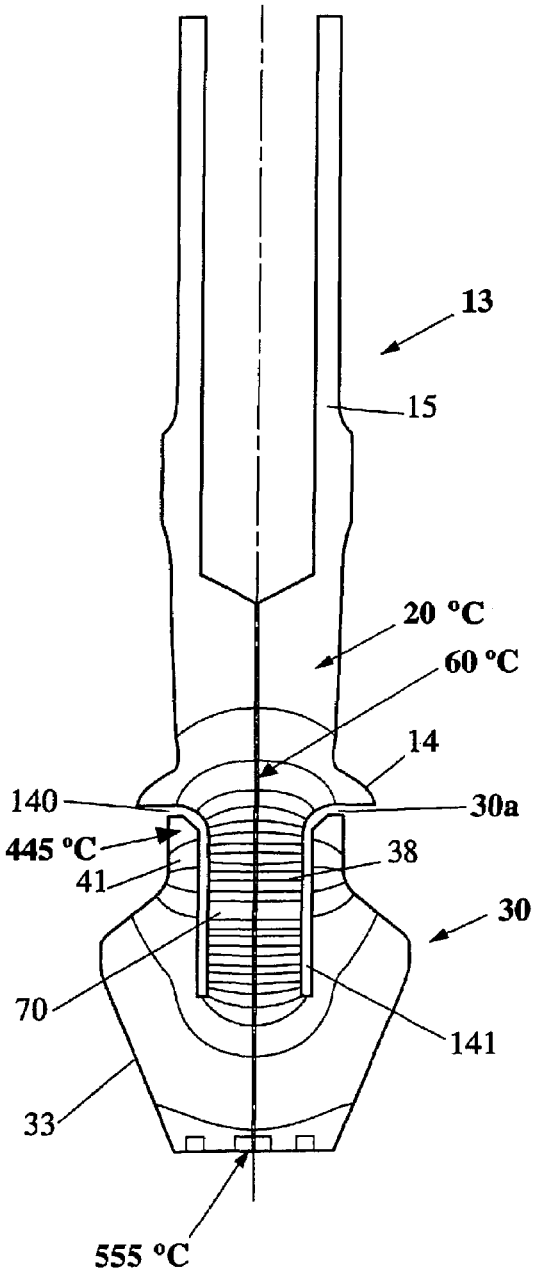
FIG. 7 is a temperature profile plot for a valve member/flow control body assembly used in an injector nozzle in accordance with one embodiment of the present invention.
Figure 8:
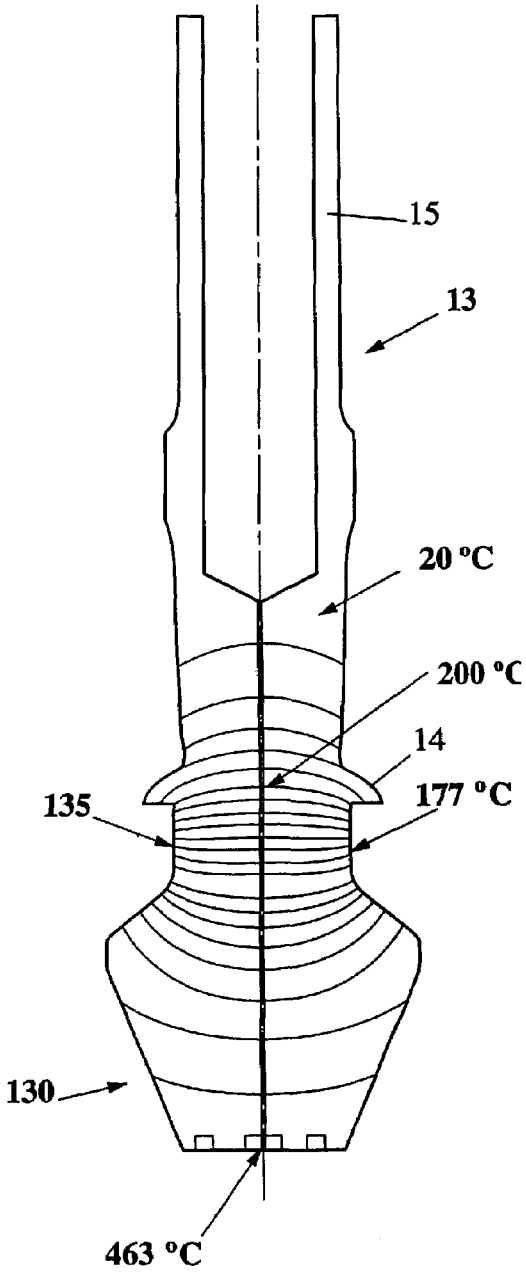
FIG. 8 is a comparative temperature profile plot of a valve element incorporating a flow control body in accordance with the prior art.

FIGS. 7 and 8 present a comparison of the temperature profile plots for valve members including flow control bodies in which an air gap or insulating region is arranged between the surface 30*a* of flow control body 30 (FIG. 7) connected to valve member 13 through a spigot portion 38; and where no air gap is left between the valve member 13 and a flow control body 130 including its connection or necked portion 135 (FIG. 8). Both temperature plots were obtained for identical engine operating conditions. It may be seen that a maximum temperature of 555° C. is achieved in FIG. 7 and a maximum of 463° C. is achieved in FIG. 8 at the base of the flow control body. The heat retention characteristics of the flow control body 30 of FIG. 7 are superior resulting in less risk of carbon deposition, better spray control and better engine performance in a fuel injector nozzle incorporating it than a fuel injector nozzle incorporating flow control body 130. That is, FIG. 7 shows that the arrangement of the insulating regions on the flow control body 30 enables high temperatures to be maintained on the external surface 33 without such temperatures being caused in the valve member 13 or nozzle body 10 which are isolated from the extremeties of the flow control body 30. Furthermore, the external surface 33 at and adjacent the necked-in region adjacent the valve head 14, which in certain arrangements may be a critical area so far as deposit formation is concerned, is able to be maintained at a significantly higher temperature (i.e., 445° C. compared with 177° C.) without significantly increasing the level of heat transfer into the valve member 13.

Figure 10:
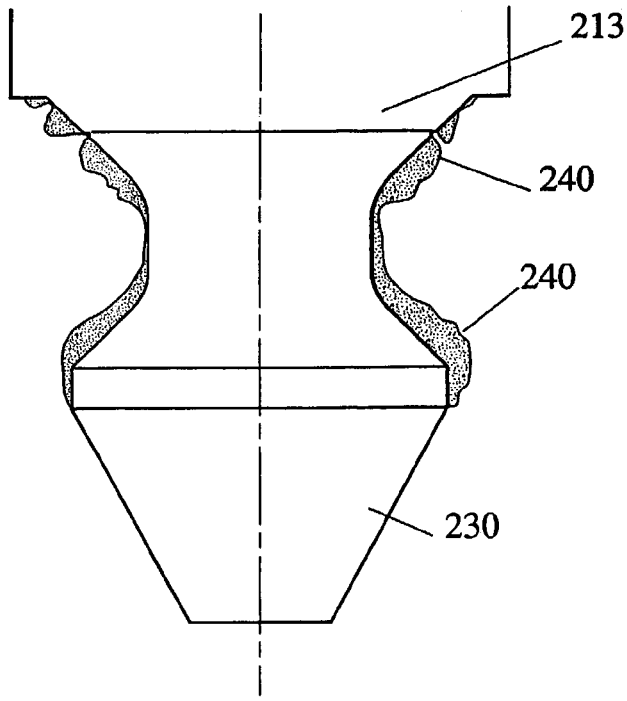
FIG. 10 is a perspective view of a valve element incorporating a flow control body in accordance with the prior art.

In this regard, FIG. 10 depicts a prior art valve element and flow control body 230 where no insulating regions are included within the control body 230 and provides an example of where carbon deposits are likely to form during operation. Accordingly, such deposits 240 are less likely to form adjacent the valve member 213 and on certain surfaces of the control body 230 where the flow control body were to include the insulating regions and heat transfer restriction features of the present invention.

As can be seen in FIG. 7, a relatively cool region within the injector body 10 is separated from a comparatively hot region on the flow control body 30 by way of the insulating portions 140, 141 and a thermal gradient region 70. The gradient region 70 is predominantly controlled to be within the flow control body 30 and more particularly is located internally of the external surface 33. The hot region is in fact more so present at and adjacent the external surface 33. Due to the presence of the insulating portions 140 and 141 between the hot region and the cool region and gradient region 70 respectively, the hot region which is proximate the cool region (at the insulating portion 140) is able to extend away from the cool region substantially independently of the thermal gradient region 70. The containment of the gradient region 70 internally of the external surface 33 together with the location of the hot region at and adjacent the external surface 33 of the flow control body serve to facilitate operation of the critical surfaces of the flow control body 30 at temperatures above the carbon forming range thereby providing effective injector deposit control. As adhered to hereinabove, this is particularly so at the necked-in region of the flow control body 30 where the presence of such deposits could disrupt the injected spray plume.

Figure 9:
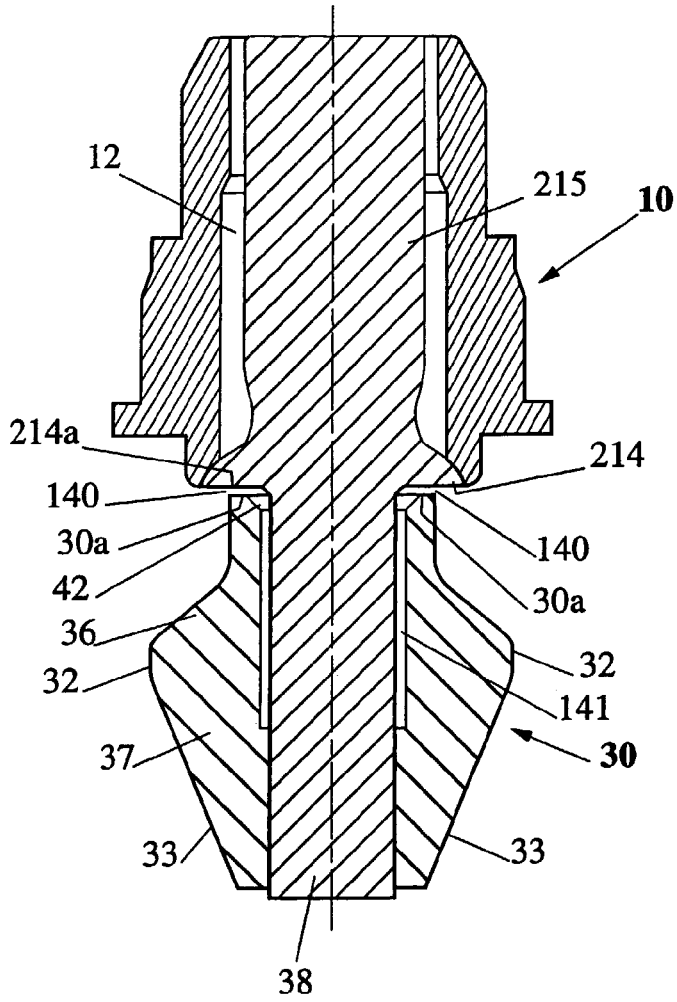
FIG. 9 is a sectional view of an alternative injector nozzle to that shown in FIG. 2.

The present invention is applicable to poppet type fuel injector nozzles of all constructions where the fuel issues therefrom in the form of a plume including injectors where fuel alone is injected or where fuel entrained in a combustion supporting or enhancing gas, such as air, is injected. An alternative injector nozzle to that described above is shown in FIG. 9. It will be noted that the valve stem 215 of the valve member 214 is solid rather than hollow in this case. Examples of specific nozzle constructions to which the invention can be applied are disclosed in the Applicant's U.S. Pat. Nos. RE36768, 5,090,625, 5,593,095, and 5,685,492 all of which are incorporated herein by way of reference. Also, the injector nozzles as disclosed herein can be used for injecting other fluids in addition to fuel with similar beneficial control of the fuel or fluid spray. Furthermore, the injector nozzle of the invention may equally well be used in valves of the pintle type.

The fuel injector nozzle of the present invention may be used in association with methods for reducing or controlling carbon particles or other build-up as disclosed in the Applicant's U.S. Pat. Nos 5,090,625 and 5,593,095. Furthermore, the fuel injector nozzle of the present invention is particularly applicable for use in association with other deposit control methods such as those disclosed in the Applicants co-pending Australian Provisional Patent Application Nos. PQ7081 and PQ7082.

This invention is not intended to be limited by the foregoing description and other variations may be developed by those skilled in the art which fall within the scope of the invention. It is to be understood that the present invention may be applied to injector nozzles supplying fuel directly into the combustion chamber or into the engine air supply system, and may be applied to both two and four stroke cycle engines, particularly those designed to operate with a stratified fuel distribution at certain points of the engine operating load range. Indeed, the invention may be applied with particular benefit in directed injected four stroke engines operating in accordance with the Applicant's patented combustion process. In addition, the injector nozzles may be used in applications other than the delivery of fuel to internal combustion engines.

The invention claimed is:

1. An injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of movement of the valve member, said control surface being configured and positioned to promote the fluid spray established by the fluid issuing from the port to, at least in part, follow a path determined by the shape of said control surface, wherein said flow control body includes an insulating region formed by a gap at least a first portion of which is located between an end face of the valve member and a portion of the control surface closest to said end face of said valve member and opening proximate said end face; and at least a second portion of which is generally elongate and extends longitudinally along said fluid flow control body in the direction of movement of the valve member, said insulating region restricting the flow of heat between the control surface and the valve member.

2. An injector nozzle according to claim 1, wherein at least a portion of an end face of said flow control body adjacent said control surface and adjacent said end face of said valve member is maintained substantially at temperatures above carbon deposit formation temperatures.

3. An injector nozzle according to claim 1, wherein said insulating region operates in use to provide a thermal gradient region between the valve member and the flow control surface, said thermal gradient region contained internally of the flow control surface whereby said valve member is maintained substantially at temperatures bellow carbon deposit formation temperatures and said flow control surface is maintained substantially at temperatures above carbon deposit formation temperatures.

4. An injector nozzle according to claim 1, wherein the flow control body is arranged on a connection portion connected to the nozzle, the connection portion being connected to and extending outwardly from said end face of the valve member.

5. An injector nozzle according to claim 4, wherein the insulating region is arranged to extend between a surface of the connection portion and an opposed surface of the flow control body.

6. An injection nozzle according to claim 5, wherein the opposed surface of the flow control body is located adjacent a portion of the control surface of the flow control body.

7. An injector nozzle according to claim 4, wherein the connection portion is in the form of a spigot portion, and the flow control body includes a bore for accommodating at least part of the spigot portion.

8. An injector nozzle according to claim 7, wherein said at least a second portion of the gap is located between the spigot portion and the bore of the flow control body.

9. An injector nozzle according to claim 1, wherein the control surface may comprise a number of external projection surfaces which together define the control surface.

10. An injector nozzle according to claim 1, wherein the flow control body is separated from the rest of the nozzle by way of a necked in portion such that the control surface of the flow control body is spaced from the nozzle port in the direction of movement of the valve member when opening.

11. An injection nozzle according to claim 10, wherein the flow control body is connected to the end face of the valve member by the necked-in portion.

12. An injection nozzle according to claim 1, wherein the gap is partially or wholly filled by a heat insulating or low thermal conductivity material.

13. An injector nozzle according to claim 1, wherein the insulating, region is arranged to provide said flow control body with a sleeve portion adjacent said end face of said valve member.

14. An injector nozzle according to claim 1 further including one or more cavities in the flow control body for reducing heat flow to the valve member.

15. An injector nozzle according to claim 14, wherein the cavity is at least partially filled with a low thermal conductivity material.

16. An injector nozzle according to claim 1, wherein the flow control body is of substantially circular cross-section throughout its length progressively increasing in diameter from the end thereof remote from the end face of the valve member to an intermediate diametral plane or portion and progressively decreasing in diameter from said intermediate diametral plane or portion toward the opposing end thereof.

17. An injector nozzle according to claim 16, the intermediate diametral portion of the flow control body further being an intermediate generally cylindrical junction portion.

18. An injector nozzle according to claim 16, further including a generally cylindrical sleeve portion extending in longitudinal direction along the axis of movement of the valve member.

19. An injector nozzle according to claim 1, wherein the valve member is of the poppet type.

20. An injector nozzle according to claim 1, wherein the valve member is of the pintle type.

21. An injector nozzle according to claim 1, wherein the nozzle is a fuel injector nozzle for a four stroke internal combustion engine.

22. An injector nozzle according to claim 1, wherein the nozzle is a fuel injector nozzle for a two stroke internal combustion engine.

23. An injector nozzle according to claim 1, wherein the nozzle is a fuel injector nozzle arranged for use in an air-assist fuel injection system.

24. An injector nozzle according to claim 1, wherein the nozzle is a fuel injector nozzle for direct injected stratified charge engine.

25. An injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of movement of the valve member, said control surface being configured and positioned to promote the fluid spray established by the fluid issuing from the port to, at least in part, follow a path determined by the shape of said control surface, wherein said flow control body includes an insulating region at least a first portion of which is located between an end face of the valve member and a portion of the control surface closest to said end face of said valve member and at least a second portion of which is generally elongate and extends longitudinally along the direction of movement of the valve member, said insulating region restricting the flow of heat between the control surface and the valve member, wherein the insulating region of the flow control body is arranged to have a generally "L-shaped" cross-section.

26. A fuel injector nozzle having a port through which at least fuel is delivered to an engine, said nozzle further comprising a flow control body arranged external to said port and having an external control surface arranged downstream from said port, said external control surface being configured and positioned to promote the fluid spray established by fluid issuing from the port to, at least in part, follow a path determined by the shape of said external control surface, whereby, in use, said nozzle includes a relatively cool region adjacent said port arising as a consequence of fuel located internally of said nozzle and a relatively hot region on said flow control body arising as a consequence of exposure to relatively high combustion chamber temperatures, said cool region and said hot region giving rise to a thermal gradient region therebetween, and wherein at least a portion of said flow control body includes a thermal insulating region, said insulating region being located intermediate at least a portion of said cool region and at least a portion of said hot region such that said thermal gradient region is controlled so as to be contained internal to an said external control surface of the flow control body.

27. A fuel injector nozzle according to claim 26, wherein said hot region is primarily located at or immediately adjacent the external control surface.

28. A fuel injector nozzle according to claim 26, wherein a portion of said hot region is arranged in close proximity to said cool region but is separated therefrom by way of the insulating region.

29. A fuel injector nozzle according to claim 28, wherein said portion of said hot region adjacent said cool region extends away from said cool region substantially independent of the thermal gradient region.

30. A fuel injector nozzle according to claim 26, wherein a portion of said hot region is arranged in close proximity to said gradient region but is separated therefrom by way of the insulating region.

31. A fuel injector nozzle according to claim 26, wherein said flow control body defines an extremity of said nozzle and said hot region extends from said external control surface of said flow body internally of said flow control body.

32. A fuel injector nozzle according to claim 31, wherein said cool region extends from adjacent said port in a direction away from said extremity of the nozzle.

33. A fuel injector nozzle according to claim 26, wherein said flow control body and said thermal gradient region have relatively high thermal conductivity characteristics, and said insulating region has relatively low thermal conductivity characteristics.

34. A fuel injector nozzle according to claim 33, wherein said low thermal conductivity characteristics are of the order of 0.02 Watts per metre Kelvin, and said high thermal conductivity characteristics are of the order of 20 Watts per metre Kelvin.

35. A fuel injector nozzle according to claim 26, wherein said relatively hot region is during operation at a temperature above which combustion deposits form.

36. An injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of fluid delivery, said control surface being configured and positioned to promote the fluid spray established by the fluid issuing from the port to, in part, follow a path determined by the shape of said control surface, wherein said flow control body includes an insulating region arranged so as to restrict the transfer of heat from the control surface to the nozzle and wherein the insulating region of the flow control body is arranged to have a generally "L-shaped" cross-section.

37. An injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of fluid delivery, said control surface being configured and positioned to promote the fluid spray established by the fluid issuing from the port to in part follow a path determined by the shape of said control surface, wherein said flow control body includes a sleeve member formed intermediate said flow control surface and an insulating region and wherein at least a portion of said insulating region extends between an end face of said valve member and a portion of said flow control surface closest to said end face of said valve member.

38. An injector nozzle as claimed in claim 37 wherein the flow control body is arranged on a connection portion connected to the nozzle, the connection portion being connected to and extending outwardly from the end face of the valve member of the nozzle.

39. An injector nozzle as claimed in claim 38 wherein said insulating region is located intermediate said connection portion and said sleeve.

40. An injector nozzle as claimed in claim 37 wherein said sleeve extends longitudinally to the axis of opening of said nozzle.

41. An injector nozzle as claimed in claim 40 wherein said sleeve is generally cylindrical.

42. An injector nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, and said injector nozzle having a fluid flow control body located beyond an extremity of the port, said flow control body having a control surface arranged downstream from the port in the direction of movement of the valve member, said control surface being configured and positioned to promote the fluid spray established by the fluid issuing from the port to, at least in part, follow a path determined by the shape of said control surface, wherein said flow control body includes an insulating region at least a portion of which is located between an end face of the valve member and a portion of the control surface closest to said end face of said valve member and said insulating region arranged so as to restrict the transfer of heat between the control surface and the valve member whereby, in operation, said portion of said control surface closest to said end face of the valve member is maintained substantially at temperatures above carbon deposit formation temperatures.

* * * * *